US008303140B2

(12) United States Patent
Lin

(10) Patent No.: US 8,303,140 B2
(45) Date of Patent: Nov. 6, 2012

(54) LIGHTING DEVICE

(75) Inventor: Chiun-Jie Lin, Fontana, CA (US)

(73) Assignee: Maxzone Auto Parts Corp. CA (US)

( * ) Notice: Subject to any disclaimer, the term of this patent is extended or adjusted under 35 U.S.C. 154(b) by 369 days.

(21) Appl. No.: 12/814,494

(22) Filed: Jun. 14, 2010

(65) Prior Publication Data

US 2011/0273891 A1 Nov. 10, 2011

(30) Foreign Application Priority Data

May 7, 2010 (TW) ..... 99208594 U

(51) Int. Cl.
*F21V 7/06* (2006.01)

(52) U.S. Cl. ..... 362/308; 362/539

(58) Field of Classification Search ..... 362/538, 362/539, 307, 308, 309, 311.01, 336, 338
See application file for complete search history.

(56) References Cited

U.S. PATENT DOCUMENTS 7,914,190 B2 * 3/2011 Kim et al. ..... 362/539
* cited by examiner

*Primary Examiner* — David V Bruce
(74) *Attorney, Agent, or Firm* — CKC & Partners Co., Ltd.

(57) ABSTRACT

A lighting device includes a parabolic reflector, a light source and a lens. The parabolic reflector has an opening. The light source is substantially located at the focus of the parabolic reflector. The lens is disposed in front of the opening of the parabolic reflector. The lens includes a plurality of convex-lens portions. The convex-lens portions are connected to each other, wherein the convex-lens portions have different focal points.

16 Claims, 3 Drawing Sheets

LIGHTING DEVICE

RELATED APPLICATIONS

The application claims priority to Taiwan Application Serial Number 99208594, filed May 7, 2010, which is herein incorporated by reference.

BACKGROUND

1. Technical Field

The present invention relates to lighting devices.

2. Description of Related Art

When the lighting device is applied to the car lamp, the illuminative range and intensity of the lighting device should conform to the traffic standard and is provides safety while driving at night or in dark places such as tunnels.

In general, the lighting device includes a lens, a light source and a gobo. The gobo is located between the lens and the light source and controls the shape of the emitted light. But, the light from the light source is focused at the focal point by the lens. It's difficult to adjust the illuminative pattern of the lighting device.

SUMMARY

According to one embodiment, a lighting device includes a parabolic reflector, a light source and a lens. The parabolic reflector has an opening. The light source is substantially located at the focus of the parabolic reflector. The lens is disposed in front of the opening of the parabolic reflector. The lens includes a plurality convex-lens portions. The convex-lens portions are connected to each other, wherein the convex-lens portions have different focal points.

According to one another embodiment, a lighting device includes a parabolic reflector, a light source and a lens. The parabolic reflector has an opening. The light source is substantially located at the focus of the parabolic reflector. The lens is disposed in front of the opening of the parabolic reflector. The lens includes a plurality of convex-lens portions. The convex-lens portions are connected to each other, wherein the convex-lens portions have different cross-section curves.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Figure 1:
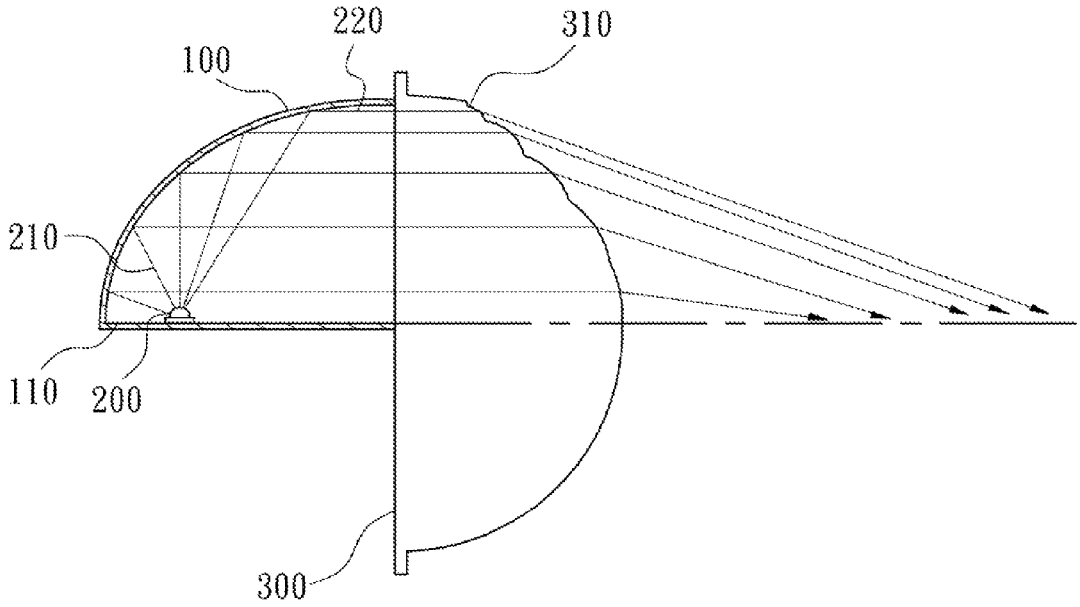
FIG. 1 is a cross-sectional view of a lighting device according to one embodiment.
Figure 2:
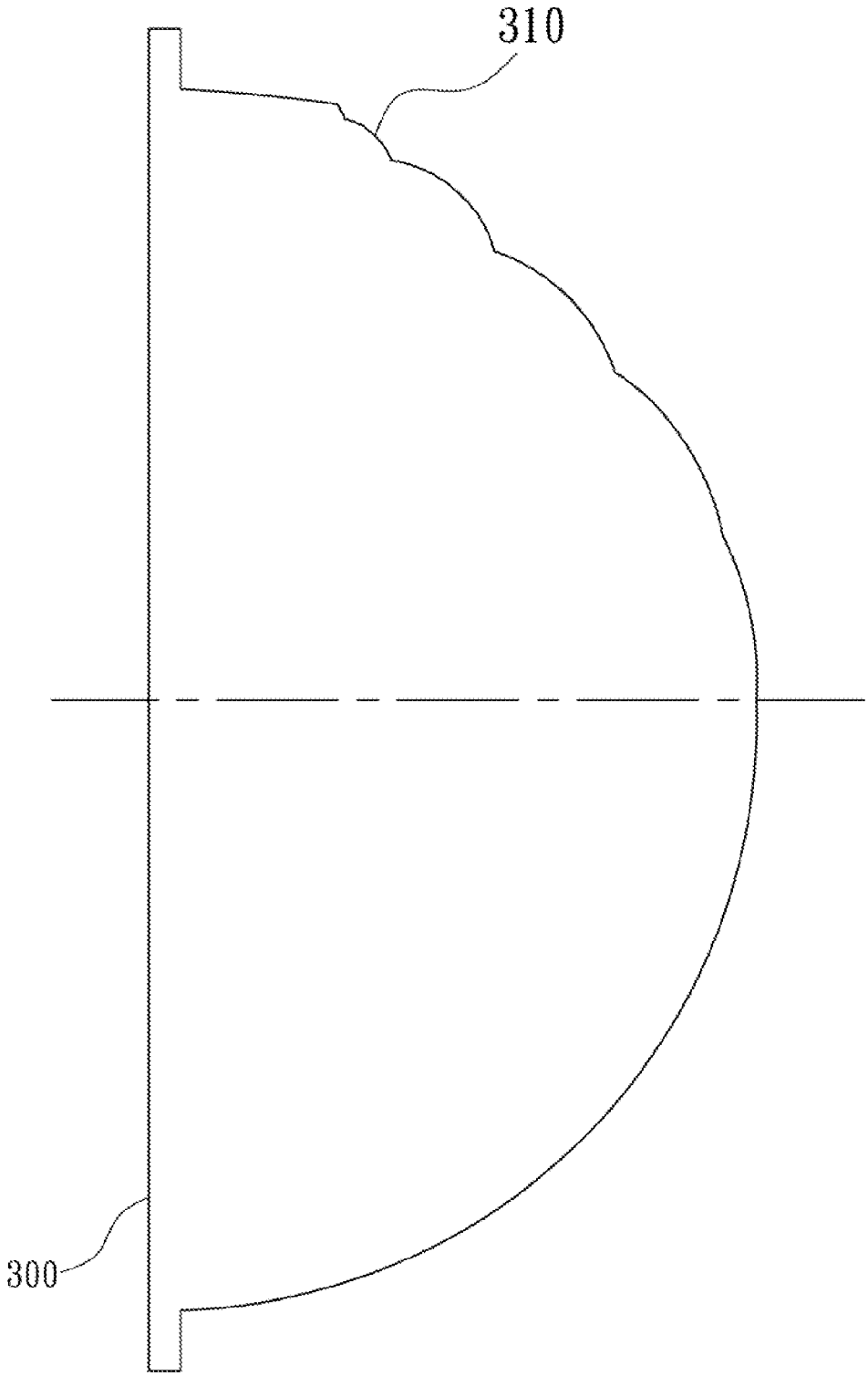
FIG. 2 is an enlarged view of the lens of the lighting device shown in FIG. 1.

FIG. 1 is a cross-sectional view of a lighting device according to one embodiment. The lighting device includes a parabolic reflector 100, light source 200 and a lens 300. The parabolic reflector 100 has an opening. The light source 200 is substantially located at the focus of the parabolic reflector 100. The lens 300 is disposed in front of the opening of the parabolic reflector 100. The lens 300 includes a plurality of convex-lens portions 310. The convex-lens portions 310 are connected to each other, wherein the convex-lens portions 310 have different focal points. In other words, each of the convex-lens portions 310 has different cross-section curves.

The parabolic reflector 100 of the lighting device of FIG. 1 is half-parabolic and the reflected surface of the parabolic reflector 100 is faced toward the ground. The light source 200 is an LED. The light source 200 is substantially located at the focus of the parabolic reflector 100 and provides a light beam 210. The parabolic reflector 100 reflects the light beam 210 into a collimated beam 220 along the optical axis 110 of the parabolic reflector 100. The collimated beam 220 can be focused at the different focal points by the different convex-lens portions 310. Therefore, when the lighting device is applied to the car lamp, the lighting device can illuminate the ground for the security during driving.

The terms "substantially" as used herein may be applied to modify any quantitative representation which could permissibly vary without resulting in a change in the basic function to which it is related. For example, when the producer assembles the light source 200 and the parabolic reflector 100, there is a distance tolerance between the focus of the parabolic reflector 100 and the light source 200 inevitably. The allowable distance tolerance between the focus of the parabolic reflector 100 and the light source 200 is from between about 1 mm to about 2 mm.

In detail, the equation of the cross-section curves of the plurality of convex-lens portions 310 having a general formula as following:

$$y = \sum_{i=0}^{n} C_i X^i$$

where (1) y is the equation of the cross-section curves of the plurality of convex-lens portions 310;

(2) x is the curved-surface diameter of the plurality of convex-lens portions 310;

(3) i is the order of the equation, wherein the higher the order is, the is smoother the curved-surface of the lens is; and (4) C is a constant which depends on the refractive index of the material of the lens 300, the curved-surface diameter of the convex-lens portions 310, the illuminative pattern of the lighting device (such as illuminated area) and the refractive index of the environment.

In FIG. 1, the number of the convex-lens portions 310 is five. The convex-lens portions 310 have different curved-surface diameters and different equations of the cross-section curves of the convex-lens portions 310 as following:

(1) the curved-surface diameter is 10 mm, and the equation for the cross-section curves is $$y=-1027.8X^3+168.2X^2-23.1X+5.1;$$

(2) the curved-surface diameter is 20 mm, and the equation for the cross-section curves is $$y=-6.4428X^3-0.4436X^2-7.244X+10.0042;$$

(3) the curved-surface diameter is 30 mm, and the equation for the cross-section curves is $$y=-0.2398X^3-0.4524X^2-4.5798X+15.0004;$$

(4) the curved-surface diameter is 40 mm, and the equation for the cross-section curves is $$y=-0.0421X^3-0.1928X^2-3.2648X+20.0002; \text{ and}$$

(5) the curved-surface diameter is 50 mm, and the equation for the cross-section curves is $$y=-0.0199X^3-0.1149X^2-2.4398X+25.0002.$$

Therefore, the collimated beam 220 from the parabolic reflector 100 can be focused at the different focal points by the different convex-lens portions 310. The producer can use different convex-lens portion 310 for adjusting the illuminative patterns (such as illuminative range, intensity) of the lighting device.

The lens 300 is made of light-transmittable material, such as Poly Carbonate (PC), PolyMethyl MethAcrylate (PMMA) or glass.

Figure 3:
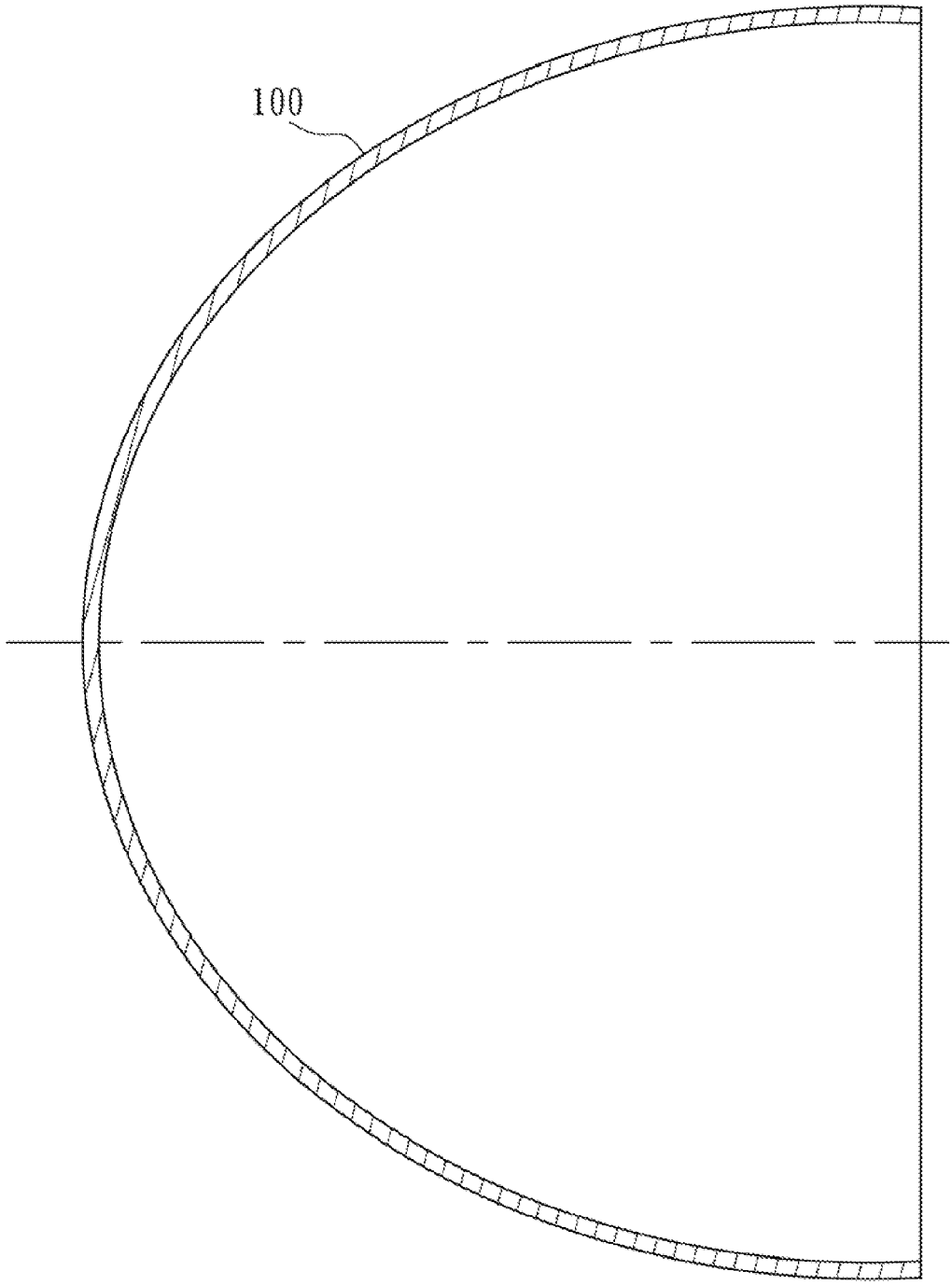
FIG. 3 is a cross-sectional view of a parabolic reflector according to another embodiment.

FIG. 3 is a cross-sectional view of a parabolic reflector 100 according to another embodiment. Although the present invention has been described in considerable detail with reference certain embodiments thereof, other embodiments are possible. For example, the parabolic reflector 100 can be other form of parabolic which can covers the illumination of the light source 200, such as a complete parabolic in FIG. 3. Therefore, their spirit and scope of the appended claims should no be limited to the description of the embodiments container herein.

What is claimed is:

1. A lighting device comprising:

a parabolic reflector having an opening;

a light source substantially located at the focus of the parabolic reflector; and a lens disposed in front of the opening of the parabolic reflector, the lens comprising:

a plurality of convex-lens portions connected to each other, wherein the convex-lens portions have different focal points.

2. The lighting device of claim 1, wherein the parabolic reflector covers the illumination of the light source.

3. The lighting device of claim 1, wherein the number of the convex-lens portions is five.

4. The lighting device of claim 1, wherein an allowable distance tolerance between the focus of the parabolic reflector and the light source is from between about 1 mm to about 2 mm.

5. The lighting device of claim 1, wherein the light source is an LED.

6. The lighting device of claim 1, wherein the lens is made of a light-transmittable material.

7. The lighting device of claim 6, wherein the lens is made of Poly Carbonate (PC).

8. The lighting device of claim 6, wherein the lens is made of PolyMethyl MethAcrylate (PMMA).

9. A lighting device comprising:

a parabolic reflector having an opening;

a light source substantially located at the focus of the parabolic reflector; and a lens disposed in front of the opening of the parabolic reflector, the lens comprising:

a plurality of convex-lens portions connected to each other, wherein the convex-lens portions have different cross-section curves.

10. The lighting device of claim 9, wherein the number of the convex-lens portions is five.

11. The lighting device of claim 9, wherein the parabolic reflector covers the illumination of the light source.

12. The lighting device of claim 9, wherein an allowable distance tolerance between the focus of the parabolic reflector and the light source is from between about 1 mm to about 2 mm.

13. The lighting device of claim 9, wherein the light source is an LED.

14. The lighting device of claim 9, wherein the lens is made of a light-transmittable material.

15. The lighting device of claim 14, wherein the lens is made of Poly Carbonate (PC).

16. The lighting device of claim 14, wherein the lens is made of PolyMethyl MethAcrylate (PMMA).

* * * * *